US006392627B1

(12) United States Patent
Maekawa

(10) Patent No.: US 6,392,627 B1
(45) Date of Patent: May 21, 2002

(54) LIQUID CRYSTAL DISPLAY DEVICE AND DRIVER CIRCUIT THEREOF

(75) Inventor: Toshikazu Maekawa, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/253,948

(22) Filed: Feb. 22, 1999

(30) Foreign Application Priority Data

Feb. 25, 1998 (JP) ..... 10-043082

(51) Int. Cl.[7] ..... G09G 3/18

(52) U.S. Cl. ..... 345/98; 345/100; 345/92; 345/204

(58) Field of Search ..... 345/92, 99, 98, 345/100, 211, 212, 210, 204, 205; 327/291, 333; 377/69, 75, 77, 81, 76

(56) References Cited

U.S. PATENT DOCUMENTS 4,779,956 A * 10/1988 Nemoto et al. ..... 340/784
5,051,739 A * 9/1991 Hayashida et al. ..... 340/784
5,222,082 A * 6/1993 Plus ..... 377/79
5,646,642 A * 7/1997 Maekawa ..... 345/99
6,028,598 A * 2/2000 Suyama et al. ..... 345/211

* cited by examiner

*Primary Examiner*—Lun-Yi Lao
(74) *Attorney, Agent, or Firm*—Rader, Fishman & Grauer PLLC; Ronald P. Kananen, Esq.

(57) ABSTRACT

An output buffer is composed of first and second CMOS inverters that are connected to each other in cascade, a level conversion circuit for converting the low-voltage-side potential of output voltages of the first and second CMOS inverters to a potential that is lower than the low-voltage-side potential, and a third CMOS inverter provided downstream of the level conversion circuit. Since the level conversion circuit has a current mirror circuit configuration, the power consumption in the level conversion circuit is made small.

10 Claims, 8 Drawing Sheets

LIQUID CRYSTAL DISPLAY DEVICE AND DRIVER CIRCUIT THEREOF

BACKGROUND OF THE INVENTION

The present invention relates to a liquid crystal display device (hereinafter referred to as LCD) and a driver circuit thereof. In particular, the invention relates to an active matrix LCD in which a number of pixels that are arranged two-dimensionally in matrix form are sequentially selected on a pixel-by-pixel basis, and to a vertical driver circuit thereof.

Among driving methods of an active matrix LCD are a 1H inversion driving method and a dot inversion driving method. In the 1H inversion driving method, the polarity of video signals applied to respective pixels is inverted every 1H (H: horizontal period) with respect to a common voltage VCOM. In the dot inversion driving method, the polarities of video signals applied to adjacent pixels (dots) are inverted alternately.

Selection is made between the above two driving methods in accordance with an intended use. The 1H inversion driving method is mainly used in small-size LCDs. By combining the 1H inversion driving method with a common inversion driving method in which a common voltage VCOM that is applied to opposed electrodes of liquid crystal cells of the respective pixels is inverted every 1H, reduction in voltage and power consumption is attained in a source driver (i.e., a horizontal driver circuit) and hence in the active matrix LCD.

The common inversion driving method, which is useful for reduction in voltage and power consumption, is widely used in medium-size LCDs (about 12 inches). In the common inversion driving method, the output voltage of a scan driver (vertical driver circuit) needs to have a negative low-voltage-side potential. The reason will be explained below with reference to FIG. 1 (equivalent circuit of a pixel section) and FIG. 2 (waveforms).

Assume that VCOMc represents the center potential of a common voltage VCOM and Vcom represents its amplitude, and that the common voltage VCOM is inverted every 1H in the following manner:

$$CVOM=VCOMc\pm(1/2)Vcom$$

In this case, a voltage VA that is held at node A is shifted by $$\Delta VA=\pm(Cs+CLC)Vcom/(Cs+CLC+Cp)$$

where Cs is the capacitance value of an auxiliary capacitor 101, CLC is the capacitance value of a liquid crystal cell 102, and Cp is the capacitance value of a parasitic capacitance at node A of a pixel transistor 103.

If the potential VA at node A has become lower than the potential of a scanning line (gate line) 104 and the pixel transistor 103 has been turned on, the holding potential VA at node A is varied and a bright spot or the like possibly occurs. Therefore, so that the pixel transistor 103 is never turned on in a non-selection period, it is necessary that the output voltage of the scan driver have a negative low-voltage-side potential. FIG. 3 shows an example of a conventional scan driver that outputs a negative low-voltage-side potential. Specifically, FIG. 3 shows the configuration of an output stage of a certain row of the scan driver.

In the output stage of this conventional scan driver, assume a case where the low-voltage-side potential of the scan driver is set at −4 V. For example, four CMOS inverters 111–114 are connected to each other in cascade. For example, +15 V is commonly applied to the respective stages of the CMOS inverters 111–114 as a positive-side power source voltage vdd. On the other hand, −1 V, −2 V, −3 V, and −4 V are applied to the respective stages of the CMOS inverters 111–114 as negative-side power source voltages vss, vss1, vss2, and vss3. That is, negative voltages are applied so as to increase in absolute value step by step in such a range that the transistors of each stage is not turned on completely.

However, in the conventional scan driver having the above configuration, since the negative-side power source voltages for the first to fourth CMOS inverters 111–114 are so set as to decrease in order, the negative-side power source voltage for a certain stage is necessarily lower than that for the preceding stage and hence a through-current (DC current) flows through the second and following CMOS inverters 112–114. This causes a problem of large current consumption. In particular, the through-current and hence the current consumption increase as the absolute values of the negative-side power source voltages increase.

The amplitude of a final output voltage vout is determined by the on-resistance ratio between the PMOS transistor and the NMOS transistor of the fourth-stage CMOS inverter 114. This causes another problem that the high-voltage-side potential of the output voltage vout drops from +15 V by ΔV. FIG. 4 shows waveforms of the positive-side power source voltage vdd, the negative-side power source voltages vss, vss1, vss2, and vss3, and output voltages va, vb, vc, and vout of the respective CMOS inverters 111–114.

SUMMARY OF THE INVENTION

The present invention has been made in view of the above problems in the art, and an object of the invention is therefore to provide an LCD and a corresponding driver circuit that can reduce voltages and power consumption particularly in the case of accommodating common inversion driving.

According to the invention, in an LCD having a pixel section in which a plurality of pixels are arranged two-dimensionally in matrix form and a plurality of scanning lines are arranged for respective rows, and a driver circuit that sequentially outputs scanning pulses to the respective scanning lines, the driver circuit comprises, in an output stage, a level conversion circuit having a current mirror circuit configuration for shifting at least one of a low-voltage-side potential and a high-voltage-side potential of the scanning pulses.

In the LCD or the driver circuit having the above configuration, the level conversion circuit for shifting the potential of an output voltage as a scanning pulse has a current mirror circuit configuration. Since current flows through the level conversion circuit only during a certain duty period of an input pulse, the power consumption in the level conversion circuit is made small.

DETAILED DESCRIPTION OF THE PREFERRED EMBODIMENTS

Figure 1:
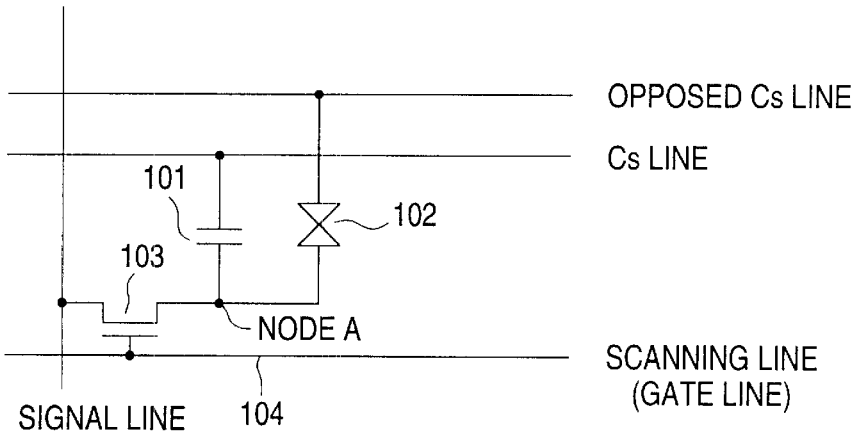
FIG. 1 is an equivalent circuit diagram of a pixel section.
Figure 2:
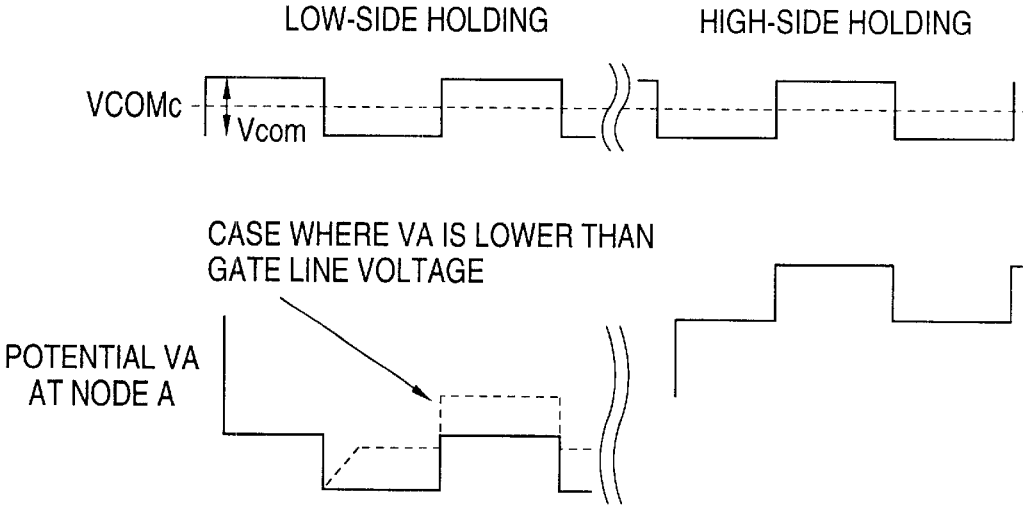
FIG. 2 is a waveform diagram showing behavior of a pixel potential in a common inversion operation.
Figure 3:
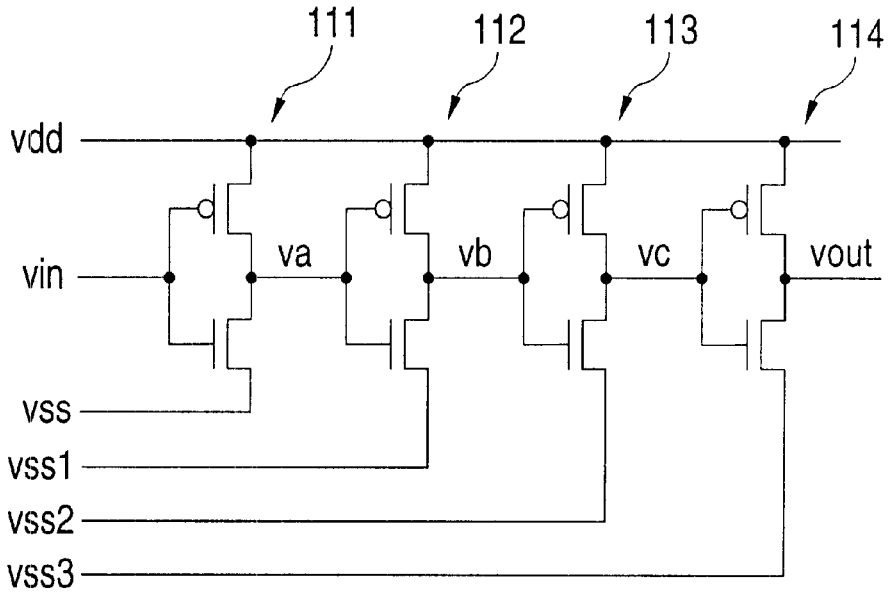
FIG. 3 is a circuit diagram of an example of a conventional scan driver.
Figure 4:
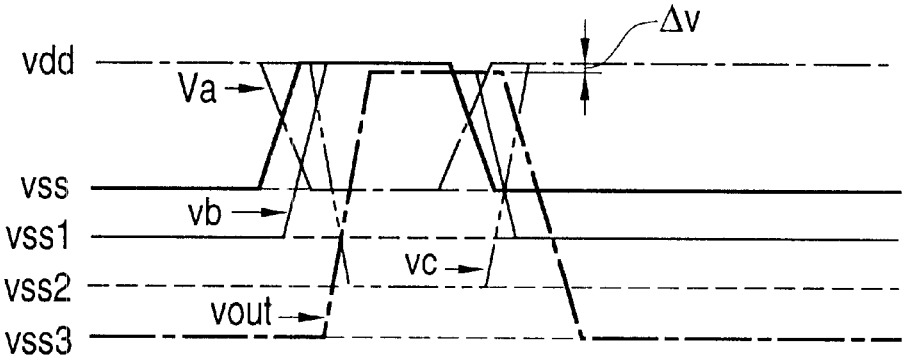
FIG. 4 is a waveform diagram showing an operation of the conventional scan driver of FIG. 3.
Figure 5:
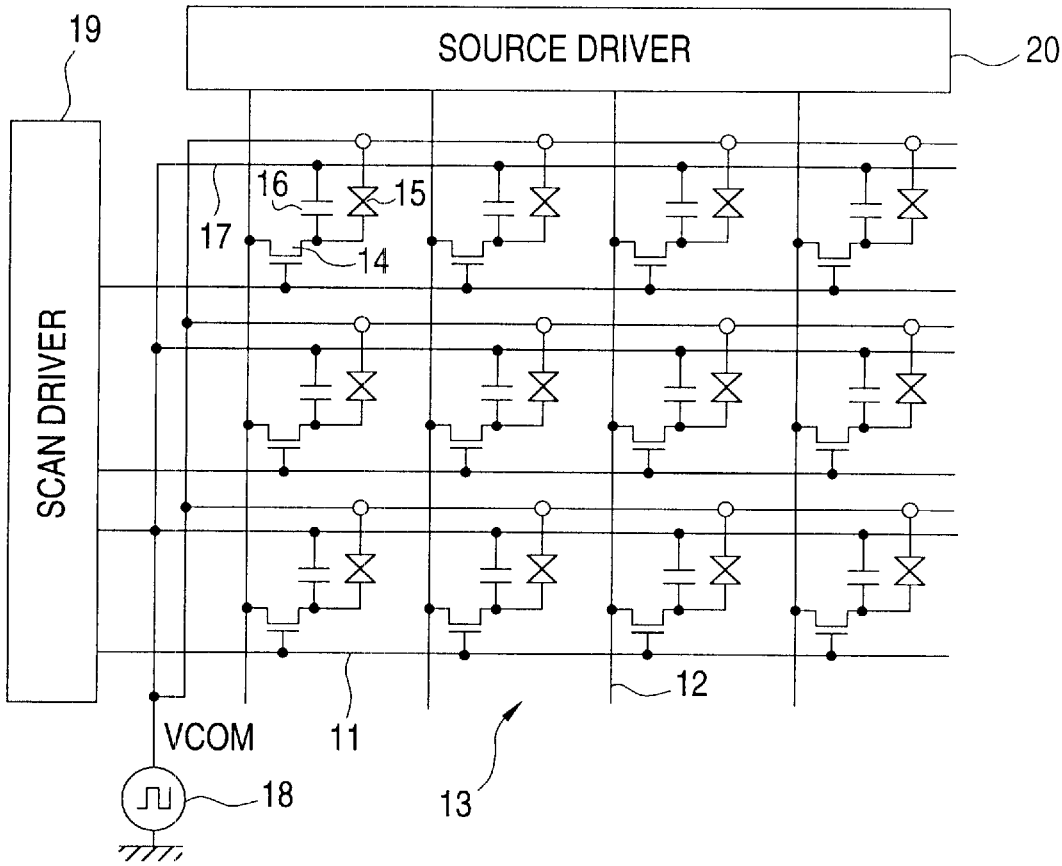
FIG. 5 schematically shows the configuration of an example of an active matrix LCD to which the present invention is applied.

Embodiments of the present invention will be hereinafter described in detail with reference to the accompanying drawings. FIG. 5 schematically shows the configuration of an example of an active matrix LCD to which the invention is applied, in which a combination of 1H inversion and common inversion is employed as a driving method.

As shown in FIG. 5, pixels 13 are provided at crossing portions of plural rows of scanning lines 11 and plural columns of signal lines 12. Each pixel 13 is composed of a pixel transistor (e.g., a thin-film transistor) 14 whose gate electrode and source electrode are connected to a scanning line 11 and a signal line 12, respectively, a liquid crystal cell 15 whose pixel electrode is connected to the drain electrode of the pixel transistor 14, and an auxiliary capacitor 16, where one of the electrodes of the auxiliary capacitor 16 is connected to the drain electrode of the pixel transistor 14.

Figure 6A:
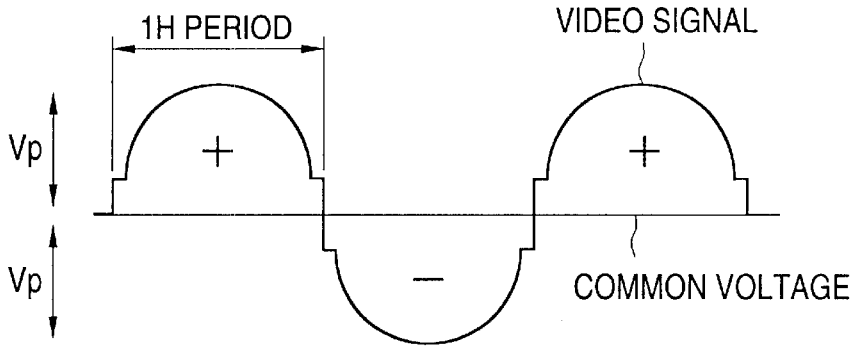
FIGS. 6A and 6B show waveforms of 1H inversion driving and a combination of 1H inversion driving and common inversion driving, respectively.
Figure 6B:
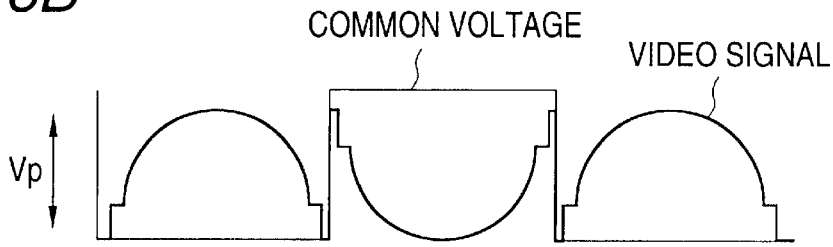

Opposite electrodes of the respective liquid crystal cells 15 are connected to each other so as to be common to the pixels 13. Similarly, the other electrodes (second electrodes) of the respective auxiliary capacitors 16 are connected to each other via CS lines 17 so as to be common to the pixels 13. As shown in FIG. 6B, a common voltage VCOM that is inverted every 1H is supplied from a voltage source 18 to the opposed electrodes of the respective liquid crystal cells 15 and the second electrodes of the respective auxiliary capacitors 16.

To sequentially select, on a pixel-by-pixel basis, from a number of pixels 13 that are arranged two-dimensionally, a scan driver 19 and a source driver 20 are provided as a vertical driver circuit and a horizontal driver circuit, respectively. The scan driver 19 selects pixels 13 on a row-by-row basis sequentially scanning the pixels 13 by applying scanning pulses to the respective scanning lines 11 for each vertical period (each field period).

On the other hand, the source driver 20 performs sequential sampling on an input video signal for each horizontal period (1H) and writes sampled video signals to pixels 13 of a row selected by the scan driver 19. As shown in FIG. 6A, the polarity of a video signal that is input to the source driver 20 is inverted every 1H with respect to the common voltage VCOM.

Since the liquid crystal cells 15 are driven in an AC-like manner by using the 1H inversion driving method in the above manner, the polarities of voltages applied to the liquid crystal cells 15 of the respective pixels 13 are inverted every line, whereby deterioration of the liquid crystal cells 15 can be prevented. In this 1H inversion driving method, since the polarity of a video signal is inverted every 1H, as seen from the waveform of FIG. 6A, a voltage source of at least 2 Vp is needed in the source driver 20, where Vp is a voltage necessary for a gradation control of the liquid crystal cells 15.

Where the above 1H inversion driving method is combined with the common inversion driving method, the common voltage VCOM is also inverted every 1H as seen from the waveform of FIG. 6B. Therefore, a voltage source in the source driver 20 may be one that provides a voltage Vp in the lowest case, which makes it possible to reduce voltages and power consumption in the source driver 20 while securing the advantage of the 1H inversion driving method as it is.

Figure 7:
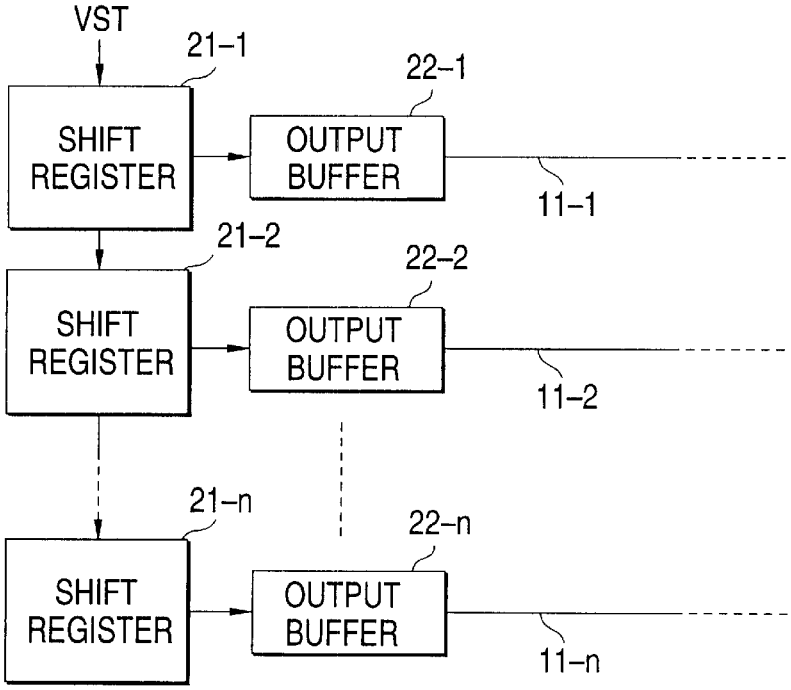
FIG. 7 is a block diagram showing an example configuration of a scan driver.

In the LCD having the above configuration, a driver circuit according to the invention is applied to the scan driver 19, and more specifically, to its output stage. For example, as shown in FIG. 7, the scan driver 19 is composed of n stages of shift registers 21-1 to 21-n (n: the number of rows of the pixel section) and output buffers 22-1 to 22-n that are provided on the output side of the respective shift registers 21-1 to 21-n and supply scanning pulses sequentially to n respective scanning lines 11-1 to 11-n. The invention is applied to each of the output buffers 22-1 to 22-n. Specific embodiments will be described below.

Figure 8:
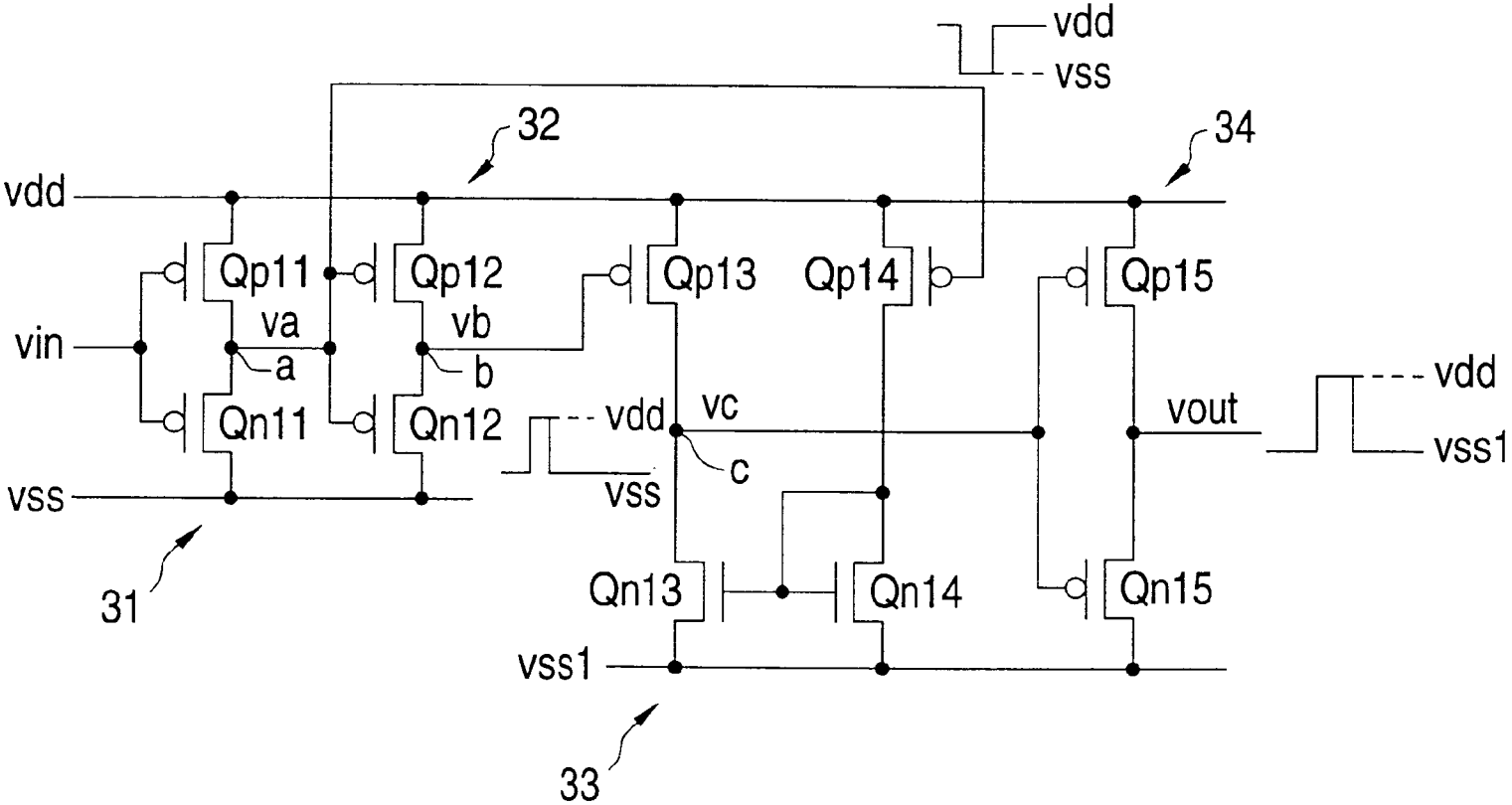
FIG. 8 is a circuit diagram of an output buffer according to a first embodiment of the invention.

FIG. 8 is a circuit diagram showing an output buffer of a certain stage of the scan driver 19 according to a first embodiment of the invention. This output buffer is composed of first and second CMOS inverters 31 and 32 that are connected to each other in a cascade formation, a level conversion circuit 33 for shifting a low-voltage-side potential vss of output voltages of the CMOS inverters 31 and 32 to a potential vss1 that is lower than vss, and a third CMOS inverter 34 that is provided downstream from the level conversion circuit 33.

The first CMOS inverter 31 is composed of a PMOS transistor Qp11, whose source is connected to a positive-side voltage source vdd, and an NMOS transistor Qn11 whose drain and gate are connected to the drain and gate, respectively, of the PMOS transistor Qp11 and whose source is connected to a first negative-side voltage source vss. Similarly, the second CMOS inverter 32 is composed of a PMOS transistor Qp12, whose source is connected to the positive-side voltage source vdd and an NMOS transistor Qn12 whose drain and gate are connected to the drain and gate, respectively, of the PMOS transistor Qp12 and whose source is connected to the first negative-side voltage source vss.

The level conversion circuit 33 has a current mirror circuit configuration. That is, the source of a PMOS transistor Qp13 is connected to the positive-side voltage source vdd and its gate is connected to an output node b of the second CMOS inverter 32. The source of a PMOS transistor Qp14 is connected to the positive-side voltage source vdd and its gate is connected to an output node a of the first CMOS inverter 31. The drain of an NMOS transistor Qn13 is connected to the drain of the PMOS transistor Qp13 and its source is connected to a second negative-side voltage source vss1 (<vss). The drain of a diode-connected NMOS transistor Qn14 is connected to the drain of the PMOS transistor Qp14, its gate is connected to the gate of the NMOS transistor Qn13, and its source is connected to the second negative-side voltage source vss1.

The third CMOS inverter 34 is composed of a PMOS transistor Qp15 whose source is connected to the positive-side voltage source vdd and an NMOS transistor Qn15 whose drain and gate are connected to the drain and gate, respectively, of the PMOS transistor Qp15 and whose source is connected to the second negative-side voltage source vss1. The input end of the third CMOS inverter 34, that is, the gate common connection point of the PMOS transistor Qp15 and the NMOS transistor Qn15 is connected to an output node c of the level conversion circuit 33, that is, the drain common connection point of the PMOS transistor Qp13 and the NMOS transistor Qn13.

In the above-configured output buffer according to the first embodiment, a voltage vdd−vss, which defines the dynamic range of output voltages va and vb of the first and second CMOS inverters 31 and 32, respectively, can have a small amplitude that is sufficient to turn on the PMOS transistors Qp13 and Qp14 of the level conversion circuit 33, for example, a small amplitude of about Vth+α where Vth is the threshold voltage of the transistors Qp13 and Qp14. In other words, the level conversion circuit 33 can operate even if the output voltages va and vb of the first and second CMOS inverters 31 and 32 have a small amplitude of about Vth+α.

An input pulse vin of this output buffer is set so that a pulse in which the low-voltage-side duty is smaller than the high-voltage-side duty is input to the level conversion circuit 33 as a gate input pulse to the PMOS transistor Qp14. As a result, during the long high-voltage-side duty period of a gate input pulse being input to the PMOS transistor Qp14, the PMOS transistor Qp14 is in a non-conductive state and no current flows through the NMOS transistors Qn14 and Qn13. Only during the short low-voltage-side duty period of the gate input pulse, the PMOS transistor Qp14 is in a conductive state and current flows through the NMOS transistors Qn14 and Qn13. That is, current flows through the level conversion circuit 33 only during a short period, and hence the power consumption is small.

Figure 9:
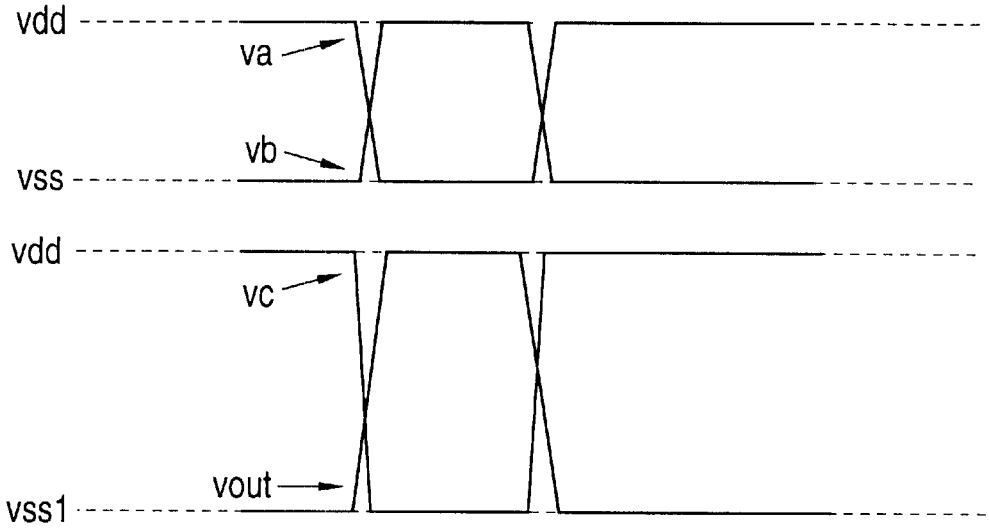
FIG. 9 is a waveform diagram showing the operation of the output buffer of FIG. 8.

The low-voltage-side potential of the output node c of the level conversion circuit 33 is defined by the second negative-side power source voltage vss1, that is, the source potential of the NMOS transistor Qn13, when it is rendered conductive as a result of a current flow due to turning-on of the PMOS transistor Qp14. For example, assume a case that the positive-side power source voltage vdd is +5 V, the first negative-side power source voltage vss is 0 V, and the second negative-side power source voltage vss1 is −4 V. In this case, the level conversion circuit 33 converts an input voltage to an output voltage vc whose high-voltage-side potential is fixed at +5 V and low-voltage-side potential is solely shifted from 0 V to −4 V. The voltage vc is inverted by the third CMOS inverter 34 and becomes an output voltage vout. FIG. 9 shows waveforms of the output voltages va, vb, vc, and vout.

As described above, in the output buffer according to the first embodiment, the level conversion circuit 33 for shifting the low-voltage-side potential of an output voltage to the negative side is a current mirror circuit. Therefore, current flows through the level conversion circuit 33 only during the low-voltage-side duty period of an input pulse and hence the power consumption can be reduced. In particular, if an input pulse is such that the low-voltage-side duty is smaller than the high-voltage-side duty, current flows through the level conversion circuit 33 only during the short low-voltage-side duty period, whereby the power consumption can further be reduced.

Figure 10:
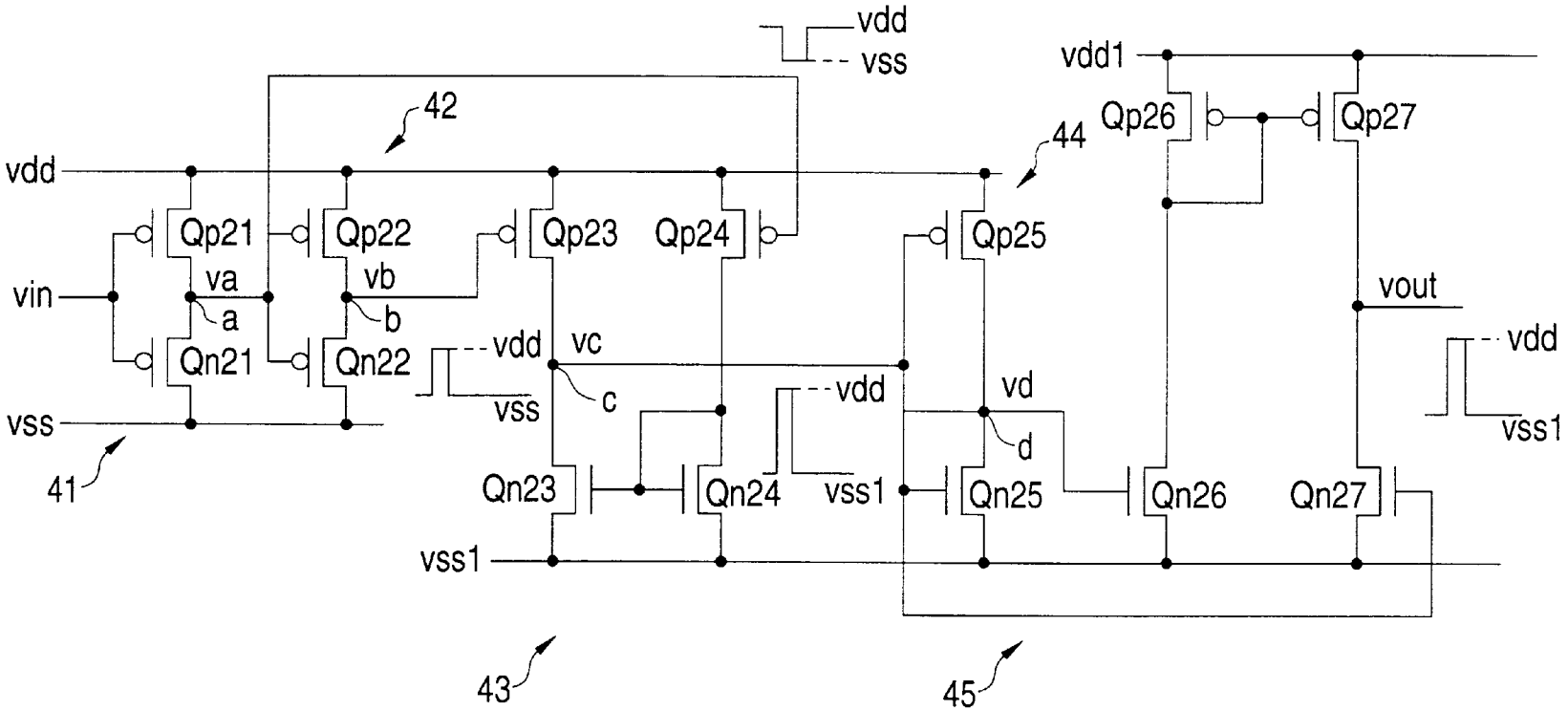
FIG. 10 is a circuit diagram of an output buffer according to a second embodiment of the invention.

FIG. 10 is a circuit diagram showing an output buffer of according to a second embodiment of the invention. This output buffer is composed of first and second CMOS inverters 41 and 42 that are connected to each other in a cascade formation, a first level conversion circuit 43 for shifting a low-voltage-side potential vss of output voltages of the CMOS inverters 41 and 42 to a potential vss1 that is lower than vss, a third CMOS inverter 44 that is provided downstream of the level conversion circuit 43, and a second level conversion circuit 45 for shifting a high-voltage-side potential vdd of an output voltage of the third CMOS inverter 44 to a potential vdd1 that is higher than vdd.

The first CMOS inverter 41 is composed of a PMOS transistor Qp21 whose source is connected to a first positive-side voltage source vdd and an NMOS transistor Qn21 whose drain and gate are connected to the drain and gate, respectively, of the PMOS transistor Qp21 and whose source is connected to a first negative-side voltage source vss. Similarly, the second CMOS inverter 42 is composed of a PMOS transistor Qp22 whose source is connected to the first positive-side voltage source vdd and an NMOS transistor Qn22 whose drain and gate are connected to the drain and gate, respectively, of the PMOS transistor Qp22 and whose source is connected to the first negative-side voltage source vss.

The first level conversion circuit 43 has a current mirror circuit configuration. That is, the source of a PMOS transistor Qp23 is connected to the first positive-side voltage source vdd and its gate is connected to an output node b of the second CMOS inverter 42. The source of a PMOS transistor Qp24 is connected to the first positive-side voltage source vdd and its gate is connected to an output node a of the first CMOS inverter 41. The drain of an NMOS transistor Qn23 is connected to the drain of the PMOS transistor Qp23 and its source is connected to a second negative-side voltage source vss1 (<vss). The drain of a diode-connected NMOS transistor Qn24 is connected to the drain of the PMOS transistor Qp24, its gate is connected to the gate of the NMOS transistor Qn23, and its source is connected to the second negative-side voltage source vss1.

The third CMOS inverter 44 is composed of a PMOS transistor Qp25 whose source is connected to the first positive-side voltage source vdd and an NMOS transistor Qn25 whose drain and gate are connected to the drain and gate, respectively, of the PMOS transistor Qp25 and whose source is connected to the second negative-side voltage source vss1. The input end of the third CMOS inverter 44, that is, the gate common connection point of the PMOS transistor Qp25 and the NMOS transistor Qn25 is connected to an output node c of the first level conversion circuit 43, that is, the drain common connection point of the PMOS transistor Qp23 and the NMOS transistor Qn23.

The second level conversion circuit 45 has a current mirror configuration. That is, the source of a diode-connected PMOS transistor Qp26 is connected to a second positive-side voltage source vdd1 (>vdd). The source of a PMOS transistor Qp27 is connected to the second positive-side voltage source vdd1 and its gate is connected to the gate of the PMOS transistor Qp26. The drain of an NMOS transistor Qn26 is connected to the drain of the PMOS transistor Qp26, its gate is connected to an output node d of the third CMOS inverter 44, and its source is connected to the second negative-side voltage source vss1. The drain of an NMOS transistor Qn27 is connected to the drain of the PMOS transistor Qp27, its gate is connected to the output node c of the first level conversion circuit 43, and its source is connected to the second negative-side voltage source vss1.

In the above-configured output buffer according to the second embodiment, as in the case of the first embodiment, a voltage vdd-vss, which defines the dynamic range of output voltages va and vb of the first and second CMOS inverters 41 and 42, respectively, can have a small amplitude that is sufficient to turn on the PMOS transistors Qp23 and Qp24 of the first level conversion circuit 43. The level conversion circuit 43 can operate even with such a small amplitude.

An input pulse vin of this output buffer is set so that a pulse in which the low-voltage-side duty is smaller than the high-voltage-side duty is input to the first level conversion circuit 43 as a gate input pulse to the PMOS transistor Qp24. As a result, only during the short low-voltage-side duty period, the PMOS transistor Qp24 is in a conductive state and current flows through the NMOS transistors Qn24 and Qn23. That is, current flows through the level conversion circuit 43 only during a short period.

The low-voltage-side potential of the output node c of the first level conversion circuit 43 is defined by the second negative-side power source voltage vss1 that is the source potential of the NMOS transistor Qn23 when it is rendered conductive as a result of a current flow due to turning-on of the PMOS transistor Qp24. For example, assume a case where the first positive-side power source voltage vdd is +5 V, the first negative-side power source voltage vss is 0 V, and the second negative-side power source voltage vss1 is −4 V. In this case, the level conversion circuit 43 converts an input voltage to a voltage vc whose high-voltage-side potential is fixed at +5 V and low-voltage-side potential has solely been shifted from 0 V to −4 V.

The voltage vc whose low-voltage-side potential has been converted from vss to vss1 is inverted by the third CMOS inverter 44 and becomes a voltage vd that has the same amplitude as the voltage vc. Then, in the second level conversion circuit 45, when the voltage vd is applied to the gate of the NMOS transistor Qn26, the NMOS transistor Qn26 is kept conductive during the high-voltage-side duty period of the voltage vd to draw current from the PMOS transistor Qp27. When the PMOS transistor Qp27 is turned on as a result, the high-voltage-side potential of an output voltage vout is defined by the second positive-side power source voltage vdd1 which is the source potential of the PMOS transistor Qp27.

Figure 11:
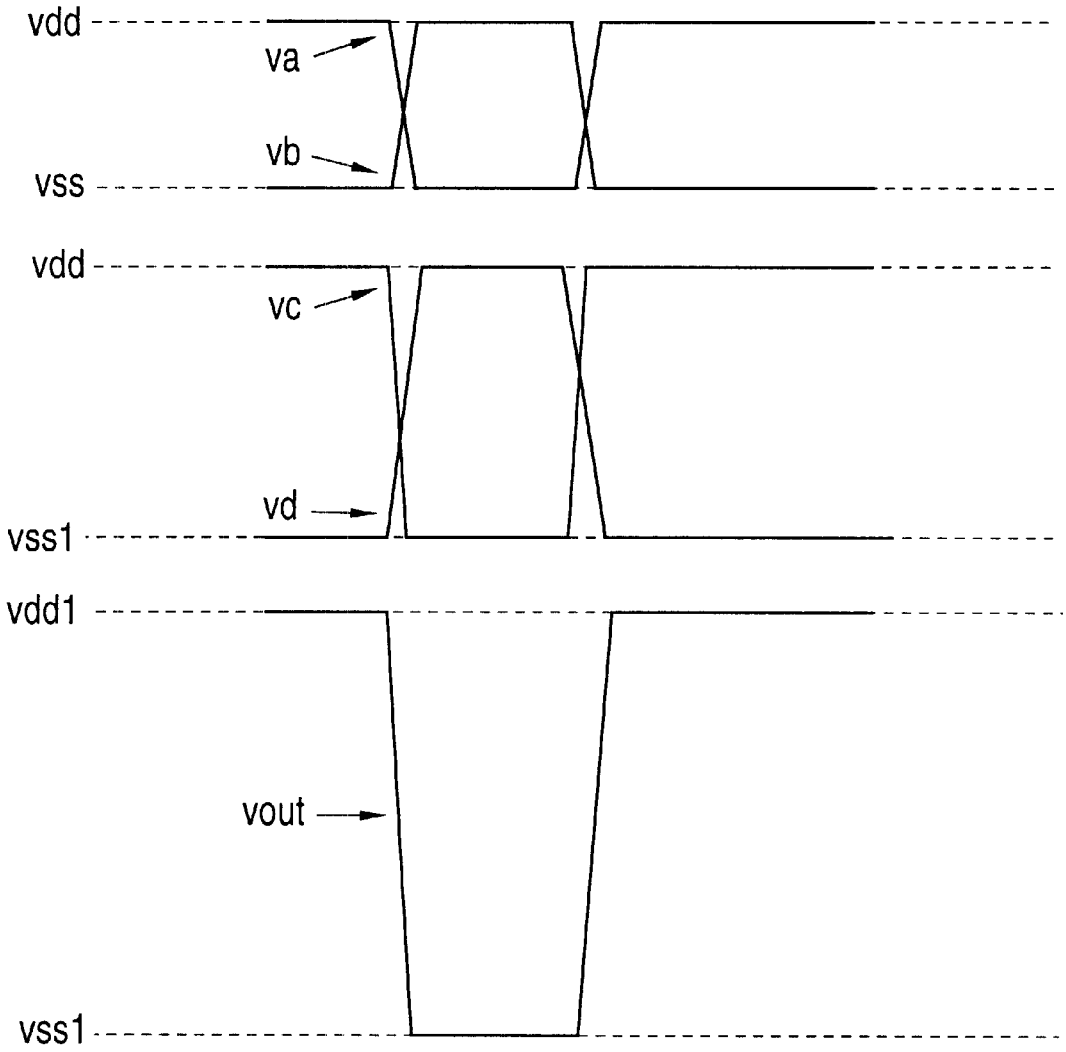
FIG. 11 is a waveform diagram showing the operation of the output buffer of FIG. 10.

For example, assume that the second positive-side power source voltage vdd1 is +15 V. In this case, the second level conversion circuit 45 produces a voltage vout whose low-voltage-side potential is fixed at −4 V and high-voltage-side potential has been shifted from +5 V to +15 V. That is, by virtue of the level conversion functions of the first and second level conversion circuits 43 and 45, the input voltage vin having an amplitude ranging from 0 V to +5 V is level-converted to the output voltage vout having an amplitude ranging from −4 V to +15 V. FIG. 11 shows waveforms of the output voltages va, vb, vc, vd and vout.

As described above, in the output buffer according to the second embodiment, both the first level conversion circuit 43 for shifting the low-voltage-side potential of an output voltage to the negative side and the second level conversion circuit 45 for shifting the high-voltage-side potential of the output voltage to the positive side is a current mirror circuit. Therefore, current flows through the first and second level conversion circuits 43 and 45 only during the low-voltage-side duty period of an input pulse, and hence the power consumption can be reduced and an output voltage having an even larger amplitude can be obtained.

The above-embodiments are directed to the case where in the active matrix LCD using the common inversion driving method, at least the low-voltage-side potential of an output voltage of the scan driver 19 is shifted to the negative side to make the low-voltage-side potential of the output voltage even lower than the negative-side power source voltage vss of the data transfer section (n-stages of shift registers) of the scan driver 19. However, the invention is not limited to such a case and can be applied to an output buffer having a configuration where only the high-voltage-side potential of an output voltage is shifted to the positive side.

As described above, the above-configured output buffers according to the above embodiments can reduce the power consumption. Therefore, by using either of those output buffers as the output buffer of the scan driver 19 of the active matrix LCD shown in FIG. 5, the power consumption in the scan driver 19 and hence in the entire LCD can be reduced particularly in what is called a driver circuit integration type active matrix LCD, in which driver circuits are formed on the same substrate as a pixel section.

Further, because the output buffer is capable of easily producing an output pulse of a large dynamic range from an input pulse of a small dynamic range, the output buffer of each embodiment facilitates the designing of an LCD panel. In addition, since an input pulse having a small amplitude of, for example, about 2.7 V can be used satisfactorily, the power source voltage can be reduced in the data transfer section (n stages of shift registers) of the scan driver 19 and the driving system upstream of the data transfer section.

In active matrix LCDs, the substrate on which driver circuits and a pixel section are formed integrally may be either a transparent substrate, such as a glass substrate or a silicon substrate.

As described above, according to the invention, in an LCD and its driver circuit, a level conversion circuit having a current mirror circuit configuration for shifting at least one of the low-voltage-side potential or the high-voltage-side potential of a scanning pulse is provided in the output stage of the driver circuit. Since current flows through the level conversion circuit only during a certain duty period of an input pulse, the power consumption in the level conversion circuit is made small. Therefore, the power consumption in the LCD and the driver circuit can be reduced.

What is claimed is:

1. A liquid crystal display device comprising:

pixel section in which a plurality of pixels are arranged two-dimensionally in matrix form and a plurality of scanning lines are arranged for respective rows; and a driver circuit for sequentially outputting scanning pulses to the respective scanning lines, the driver circuit having a current mirror circuit configuration for shifting at least one of a low-voltage-side potential and a high-voltage-side potential of the scanning pulses, wherein the driver circuit shifts the low-voltage-side potential of the scanning pulse to a potential that is lower than a negative-side power source voltage of a data transfer section of the driver circuit, wherein the driver circuit comprises:

a buffer circuit that operates on a first positive-side power source voltage and a first negative-side power source voltage; and a level shift circuit that operated on the first positive-side power source voltage and a second negative-side power source voltage that is lower than the first negative-side power source voltage, and shifts a low-voltage-side potential of an output voltage of the buffer circuit to the second negative-side power source voltage.

2. The liquid crystal display device according to claim 1, wherein the driver circuit is formed on the same substrate as the pixel section.

3. A liquid crystal display device comprising:

a pixel section in which a plurality of pixels are arranged two-dimensionally in matrix form and a plurality of scanning lines are arranged for respective rows; and a driver circuit for sequentially outputting scanning pulses to the respective scanning lines, the driver circuit having a current mirror circuit configuration for shifting at least one of a low-voltage-side potential and a high-voltage-side potential of the scanning pulses, wherein the driver circuit shifts the low-voltage-side potential of the scanning pulse to a potential that is lower than a negative-side power source voltage of a data transfer section of the driver circuit, wherein the driver circuit comprises:

a buffer circuit that operates on a first positive-side power source voltage and a first negative-side power source voltage;

a first level shift circuit that operates on the first positive-side power source voltage and a second negative-side power source voltage that is lower than the first negative-side power source voltage, and shifts a low-voltage-side potential of an output voltage of the buffer circuit to the second negative-side power source voltage; and a second level shift circuit that operates on a second positive-side power source voltage that is higher than the first positive-side power source voltage and the second negative-side power source voltage, and shifts a high-voltage potential of an output voltage of the first level shift circuit to the second positive-side power source voltage.

4. The liquid crystal display device according to claim 3, wherein the driver circuit is formed on the same substrate as the pixel section.

5. A driver circuit of a liquid display device having a pixel section in which a plurality of pixels are arranged two-dimensionally in matrix form and a plurality of scanning lines are arranged for respective rows, wherein:

the driver circuit that sequentially outputs a scanning pulses to the respective scanning lines comprises, in an output stage, a level conversion circuit having a current mirror circuit configuration for shifting at least one of a low-voltage-side potential and a high-voltage-side potential of the scanning pulses, wherein the driver circuit shifts the low-voltage-side potential of the scanning pulse to a potential that is lower than a negative-side power source voltage of a data transfer section of the driver circuit,and further comprising:

a buffer circuit that operates on a first positive-side power source voltage and a first negative-side power source voltage; and a level shifts circuit that operates on the first positive-side power source voltage and a second negative-side power source voltage that is lower than the first negative-side power source voltage, and shifts a low-voltage-side potential of an output voltage of the buffer circuit to the second negative-side power source voltage.

6. A driver circuit of a liquid display device having a pixel section in which a plurality of pixels are arranged two-dimensionally in matrix form and a plurality of scanning lines are arranged for respective rows, wherein:

the driver circuit that sequentially outputs a scanning pulses to the respective scanning lines comprises, in an output stage, a level conversion circuit having a current mirror circuit configuration for shifting at least one of a low-voltage-side potential and a high-voltage-side potential of the scanning pulses, wherein the driver circuit shifts the low-voltage-side potential of the scanning pulse to a potential that is lower than a negative-side power source voltage of a data transfer section of the driver circuit, and further comprising:

a buffer circuit that operates on a first positive-side power source voltage and a first negative-side power source voltage;

a first level shift circuit that operates on the first positive-side power voltage and a second negative-side power source voltage that is lower than the first negative-side power source voltage, and shifts a low-voltage-side potential of an output voltage of the buffer circuit to the second negative-side power source voltage; and a second level shift circuit that operates on a second positive-side power source voltage that is higher than the first positive-side power source voltage and the second negative-side power source voltage, and shifts a high-voltage-side potential of an output voltage of the first level shift circuit to the second positive-side power source voltage.

7. A display device comprising:

a pixel section in which a plurality of pixels are arranged in matrix from and a plurality of scanning lines are arranged for respective rows; and a driver configuration for sequentially outputting scanning pulses to the respective scanning lines, the driver circuit comprising, in an output stage, a level conversion circuit having a current mirror configuration for shifting at least on of a low-voltage-side potential and a high-voltage-side potential of the scanning pulses, wherein the driver circuit shifts the low-voltage-side potential of the scanning pulse to a potential that is lower than a negative-side power source voltage of a data transfer section of the driver, wherein the driver circuit comprises:

a buffer circuit that operates on a first positive-side power source voltage and a first negative-side power source voltage; and a level shift circuit that operated on the first positive power source voltage and a second negative-side power source voltage that is lower than the first negative-side power source voltage, and shifts a low-voltage-side potential of an output voltage of the buffer circuit to the second negative-side power source voltage.

8. The liquid crystal display device according to claim 7, wherein the driver circuit is formed on the same substrate as the pixel section.

9. A display device comprising:

a pixel section in which a plurality of pixels are arranged in matrix from and a plurality of scanning lines are arranged for respective rows; and a driver configuration for sequentially outputting scanning pulses to the respective scanning lines, the driver circuit comprising, in an output stage, a level conversion circuit having a current mirror configuration for shifting at least on of a low-voltage-side potential and a high-voltage-side potential of the scanning pulses, wherein the driver circuit shifts the low-voltage-side potential of the scanning pulse to a potential that is lower than a negative-side power source voltage of a data transfer section of the driver circuit, wherein the driver circuit comprises:

a buffer circuit that operates on a first positive-side power source voltage and a first negative power source voltage;

a first level shift circuit that operates on the first positive-side power source voltage and a second negative-side power source voltage that is lower than the first negative-side power source voltage, and shifts a low-voltage-side potential of an output voltage of the buffer circuit to the second negative-side power source voltage; and a second level shift circuit that operates on a second positive-side power source voltage that is higher than the first positive-side power source voltage and the second negative-side power source voltage, and shifts a high-voltage-side potential of an output of the first level circuit to the second positive-side power source.

10. The liquid crystal display device according to claim 9, wherein the driver circuit is formed on the same substrate as the pixel section.

* * * * *

UNITED STATES PATENT AND TRADEMARK OFFICE

CERTIFICATE OF CORRECTION

PATENT NO. : 6,392,627 B1
DATED : May 21, 2002
INVENTOR(S) : Toshikazu Maekawa

It is certified that error appears in the above-identified patent and that said Letters Patent is hereby corrected as shown below:

Column 9,
Lines 39 and 63, delete “a”

Column 10,
Line 10, replace “power voltage” with -- power source voltage --.
Lines 23 and 52, replace “from” with -- form --.
Lines 30 and 58, replace “on” with -- one --.
Line 40, replace “operated” with -- operate --.

Signed and Sealed this

Twenty-fifth Day of February, 2003

JAMES E. ROGAN
*Director of the United States Patent and Trademark Office*